US010615559B2

(12) United States Patent
Owen

(10) Patent No.: US 10,615,559 B2
(45) Date of Patent: Apr. 7, 2020

(54) INSERTION TOOL FOR RIGHT-ANGLED RF CONNECTORS

(71) Applicant: Lockheed Martin Corporation, Bethesda, MD (US)

(72) Inventor: Wesley S. Owen, Palmdale, CA (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 15/843,127

(22) Filed: Dec. 15, 2017

(65) Prior Publication Data

US 2019/0190222 A1 Jun. 20, 2019

(51) Int. Cl.

| | |
|---|---|
| ***H01R 43/26*** | (2006.01) |
| ***H01R 24/28*** | (2011.01) |
| ***H01R 13/646*** | (2011.01) |
| ***H01R 24/54*** | (2011.01) |
| ***H01R 24/40*** | (2011.01) |
| ***B25B 9/02*** | (2006.01) |
| ***B25B 27/04*** | (2006.01) |

(52) U.S. Cl.

CPC ..... *H01R 43/26* (2013.01); *B25B 9/02* (2013.01); *B25B 27/04* (2013.01); *H01R 13/646* (2013.01); *H01R 24/28* (2013.01); *H01R 24/40* (2013.01); *H01R 24/545* (2013.01)

(58) Field of Classification Search

CPC ..... Y10T 29/53283; Y10T 29/53257; Y10T 29/53943; Y10T 29/53274; Y10T 29/53174; Y10T 29/53209; Y10T 29/53909; Y10T 29/5393; Y10T 156/1168; Y10T 29/49815; Y10T 29/53178; H05K 13/0491; H05K 7/1415; H05K 13/0447; H01R 43/26; H01R 43/205; H01R 43/22; H01R 12/7005; H01R 13/426; H01R 13/508; H01R 43/00; B25B 27/02; B25B 31/00; B25B 9/00

USPC ..... 29/764

See application file for complete search history.

(56) References Cited

U.S. PATENT DOCUMENTS 2,320,967 A * 6/1943 Dunkelberger ..... B25J 1/04 294/100
2,549,731 A * 4/1951 Wattley ..... G01R 1/06788 294/100

(Continued)

FOREIGN PATENT DOCUMENTS

JP 2000100543 A 4/2000
WO WO-2017014018 A1 * 1/2017 ..... H01R 43/22

OTHER PUBLICATIONS

English Translation of WO 2017014018.*

*Primary Examiner* — James Harvey
*Assistant Examiner* — Matthew T Dzierzynski
(74) *Attorney, Agent, or Firm* — Baker Botts L.L.P.

(57) ABSTRACT

An apparatus includes a shaft, a slide lock, and a pin. The shaft includes a first end, a second end opposite the first end and a middle portion between the first end and the second end. The first end includes an enclosure. The middle portion includes a tapered hole. The tapered hole is tapered in a direction from the first end to the second end. The slide lock is disposed over the shaft. The pin is disposed through the tapered hole and coupled to the slide lock. The movement of the slide lock is coupled to movement of the pin within the tapered hole of the shaft. The position of the pin within the tapered hole corresponds to an amount of opening of the enclosure.

20 Claims, 5 Drawing Sheets

(56) References Cited

U.S. PATENT DOCUMENTS 2,669,896 A * 2/1954 Clough ..... B25B 9/00 294/100
3,136,040 A 6/1964 Bauer et al.
3,588,983 A 3/1969 Hoy
3,549,159 A * 12/1970 Kroener ..... B25G 3/32 279/53
3,769,680 A 11/1973 Anhalt
3,844,291 A * 10/1974 Moen ..... A61B 17/30 279/51
4,206,543 A 6/1980 Chisholm
4,263,903 A * 4/1981 Griggs ..... A61B 17/0642 227/147
4,389,770 A * 6/1983 Bocinski ..... H01R 43/22 29/758
4,425,704 A 1/1984 Cline
4,438,769 A * 3/1984 Pratt ..... A61B 17/0642 227/147
D280,550 S * 9/1985 Pratt ..... D24/27
4,575,143 A * 3/1986 Nast ..... B25J 1/04 294/100
5,222,973 A * 6/1993 Sharpe ..... A61B 17/29 294/100
5,407,243 A * 4/1995 Riemann ..... A01M 3/00 294/100
5,649,931 A * 7/1997 Bryant ..... A61B 17/8891 606/104
5,782,830 A * 7/1998 Farris ..... A61F 2/442 606/99
7,281,740 B1 * 10/2007 Fields ..... A01B 1/16 294/100
7,527,311 B2 * 5/2009 Shih ..... B25J 1/02 294/100
7,951,168 B2 * 5/2011 Chao ..... A61B 17/7077 606/246
8,104,806 B1 * 1/2012 Shih ..... B25J 1/02 294/100
8,122,900 B1 * 2/2012 Hayes ..... A45B 9/04 135/66
8,485,070 B2 * 7/2013 Darbinyan ..... B25B 13/28 81/112
2014/0366355 A1 12/2014 Goodman

* cited by examiner

INSERTION TOOL FOR RIGHT-ANGLED RF CONNECTORS

TECHNICAL FIELD

This disclosure relates in general to RF connectors, and more particularly to insertion tools for RF connectors.

BACKGROUND

Various RF connectors are used to provide connection between radio frequency ("RF") connection ports and RF wires or RF communications links. RF connections may be made using right-angled RF connectors. Right-angled RF connectors may be difficult to maneuver during installation and misalignment or improper application of force during installation may result in damage to components.

SUMMARY OF THE DISCLOSURE

According to one embodiment, an apparatus includes a shaft, a slide lock, and a pin. The shaft includes a first end, a second end opposite the first end and a middle portion between the first end and the second end. The first end includes an enclosure. The middle portion includes a tapered hole. The tapered hole is tapered in a direction from the first end to the second end. The slide lock is disposed over the shaft. The pin is disposed through the tapered hole and coupled to the slide lock. The movement of the slide lock is coupled to movement of the pin within the tapered hole of the shaft. The position of the pin within the tapered hole corresponds to an amount of opening of the enclosure.

According to another embodiment, a method includes providing a right-angled RF connector insertion tool. The right-angled RF connector insertion tool includes a shaft, a slide lock, and a pin. The shaft includes a first end, a second end opposite the first end and a middle portion between the first end and the second end. The first end includes an enclosure. The middle portion includes a tapered hole. The tapered hole is tapered in a direction from the first end to the second end. The slide lock is disposed over the shaft. The pin is disposed through the tapered hole and coupled to the slide lock. The movement of the slide lock is coupled to movement of the pin within the tapered hole of the shaft. The method further includes moving the slide lock of the right-angled RF connector insertion tool towards the second end of the shaft. The method further includes disposing a right-angled RF connector within the enclosure of the right-angled RF connector insertion tool. The method further includes moving the slide lock of the right-angled RF connector insertion tool towards the first end of the shaft. The method further includes connecting the right-angled RF connector to a RF communications port while the right-angled RF connector is disposed within the enclosure of the right-angled RF connector insertion tool.

According to yet another embodiment, a system includes a right-angled RF connector, a RF connection port, and a RF connector insertion tool. The RF connection port is configured to receive a portion of the right-angled RF connector. The RF connector insertion tool includes a shaft, a slide lock, and a pin. The shaft includes a first end, a second end opposite the first end and a middle portion between the first end and the second end. The first end includes an enclosure. The middle portion includes a tapered hole. The tapered hole is tapered in a direction from the first end to the second end. The slide lock is disposed over the shaft. The pin is disposed through the tapered hole and coupled to the slide lock. The movement of the slide lock is coupled to movement of the pin within the tapered hole of the shaft. The RF connector tool is configured to hold the right-angled RF connector within the enclosure. The RF connector tool is further configured to connect the right-angled RF connector into the RF connection port while the right-angled RF connector is held within the enclosure.

The present disclosure may provide numerous advantages. For example, an insertion tool may include a spring that provides a resistive force against the slide lock. The resistive force may cause the slide lock to move towards the first end, thereby allowing the enclosure to close without providing manual force to maintain the slide lock position. As another example, certain embodiments allow the enclosure to securely hold a right-angled RF connector. In securely holding the right-angled RF connector, the right-angled RF connector may be maneuvered and connected with greater precision and ease. As yet another example, the insertion tool may include a circumferential grove and a handle with which the insertion tool may be handled. An operator may hold the insertion tool via the handle and operate the slide lock with one or more fingers of the same hand. In certain embodiments, the insertion tool may be configured to be used single-handedly.

Other technical advantages will be readily apparent to one skilled in the art from the following figures, descriptions, and claims. Moreover, while specific advantages have been enumerated above, various embodiments may include all, some, or none of the enumerated advantages.

BRIEF DESCRIPTION OF THE DRAWINGS

For a more complete understanding of the present disclosure and its advantages, reference is now made to the following description, taken in conjunction with the accompanying drawings, in which.

DETAILED DESCRIPTION OF THE DISCLOSURE

Figure 1:
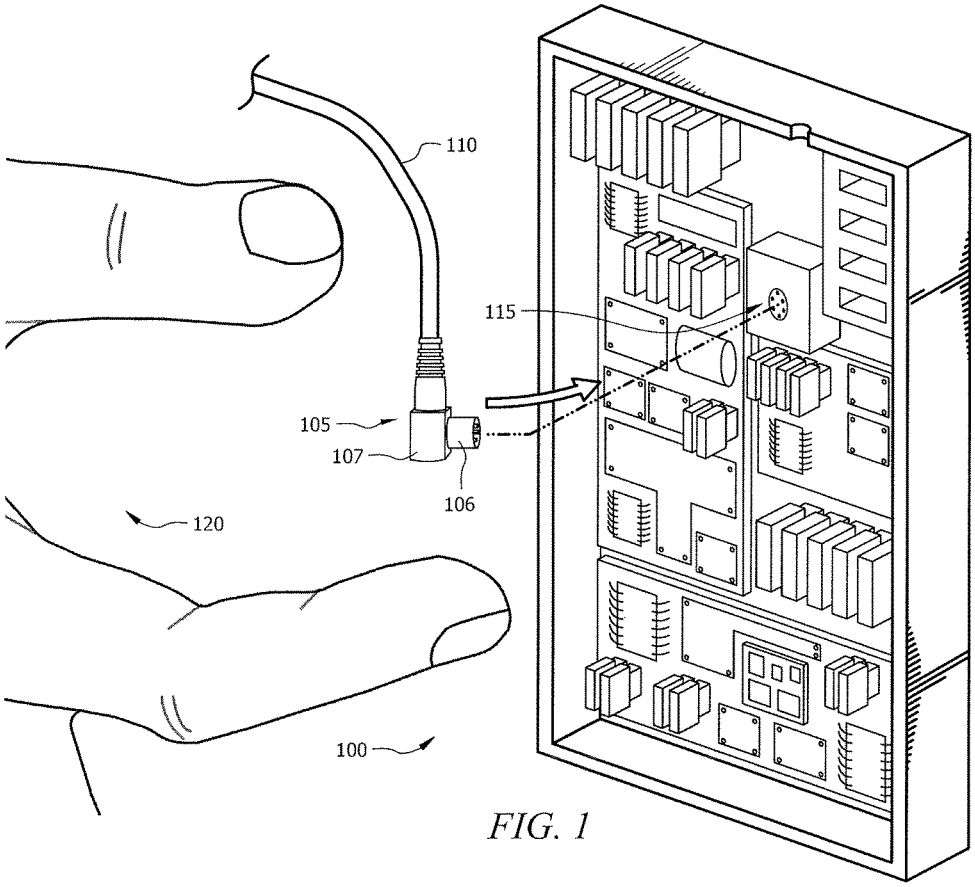
FIG. 1 illustrates an example system with a radio frequency ("RF") connection port and a right-angled RF connector, according to certain embodiments.

To facilitate a better understanding of the present disclosure, the following examples of certain embodiments are given. The following examples are not to be read to limit or define the scope of the disclosure. Embodiments of the present disclosure and its advantages are best understood by referring to FIGS. 1 through 4, where like numbers are used to indicate like and corresponding parts.

Various radio frequency ("RF") connectors may be used to connect RF wires or other communication links into RF connection ports. For example, right-angled RF connectors may be used to provide connection to an RF connection port at a 90 degree angle. Right-angled RF connectors may be useful when there is little room to connect the RF wire or little overhead within an enclosed space in which the RF connector may be installed. The right-angled RF connector provides additional installation challenges. For example, the wire connected to the connector make a 90 degree angle, which requires the application of force to connect the connector at a 90 degree angle from the direction of the wire. Thus, the wire and connector must be maneuvered in more than one direction to install the right-angled connector.

Further, in some circumstances, the space in which the RF connector is to be installed may be cramped, with one or more other components adjacent to the RF connection port. In such circumstances, the necessary precision to successfully install the right-angled RF connector is heightened. For example, the connector must be maneuvered without touching and potentially damaging the surrounding components. Additionally, the installer must be able to apply the correct amount of force to insert the connector in the proper direction. Small misalignments may fail to properly insert the connector and/or result in damage to the connector and/or RF connection port.

To address these and other problems, embodiments of the disclosure provide an insertion tool that may be used to install right-angled RF connectors. Certain insertion tools may allow an enclosure on a shaft of the insertion tool to enclose a right-angled RF connector. For example, certain insertion tools may include a shaft that defines a tapered hole through which a pin may be disposed. The pin may be moved relative to the shaft via a slide lock. The movement of the pin may be associated with the opening and the closing of the enclosure at an end of the shaft, such that the insertion tool may hold onto the right-angled RF connector during installation and disengage without affecting the insertion after installation.

Accordingly, aspects of the present disclosure include an apparatus that, in one embodiment, includes a shaft, a slide lock, and a pin. The shaft includes a first end, a second end opposite the first end and a middle portion between the first end and the second end. The first end includes an enclosure. The middle portion includes a tapered hole. The tapered hole is tapered in a direction from the first end to the second end. The slide lock is disposed over the shaft. The pin is disposed through the tapered hole and coupled to the slide lock. The movement of the slide lock is coupled to movement of the pin within the tapered hole of the shaft. The position of the pin within the tapered hole corresponds to an amount of opening of the enclosure.

Additionally, aspects of the present disclosure include a method that, in one embodiment, includes providing a right-angled RF connector insertion tool. The right-angled RF connector insertion tool includes a shaft, a slide lock, and a pin. The shaft includes a first end, a second end opposite the first end and a middle portion between the first end and the second end. The first end includes an enclosure. The middle portion includes a tapered hole. The tapered hole is tapered in a direction from the first end to the second end. The slide lock is disposed over the shaft. The pin is disposed through the tapered hole and coupled to the slide lock. The movement of the slide lock is coupled to movement of the pin within the tapered hole of the shaft. The method further includes moving the slide lock of the right-angled RF connector insertion tool towards the second end of the shaft. The method further includes disposing a right-angled RF connector within the enclosure of the right-angled RF connector insertion tool. The method further includes moving the slide lock of the right-angled RF connector insertion tool towards the first end of the shaft. The method further includes connecting the right-angled RF connector to a RF communications port while the right-angled RF connector is disposed within the enclosure of the right-angled RF connector insertion tool.

The present disclosure may provide numerous advantages. For example, the insertion tool may include a spring that provides a resistive force against the slide lock. The resistive force may cause the slide lock to move towards the first end, thereby allowing the enclosure to close without providing manual force to maintain the slide lock position. As another example, certain embodiments allow the enclosure to securely hold a right-angled RF connector. In securely holding the right-angled RF connector, the right-angled RF connector may be maneuvered and connected with greater precision and ease. As yet another example, the insertion tool may include a circumferential grove and a handle with which the insertion tool may be handled. An operator may hold the insertion tool via the handle and operate the slide lock with one or more fingers of the same hand. In certain embodiments, the insertion tool may be configured to be used single-handedly.

Other technical advantages will be readily apparent to one skilled in the art from the following figures, descriptions, and claims. Moreover, while specific advantages have been enumerated above, various embodiments may include all, some, or none of the enumerated advantages.

Figure 2A:
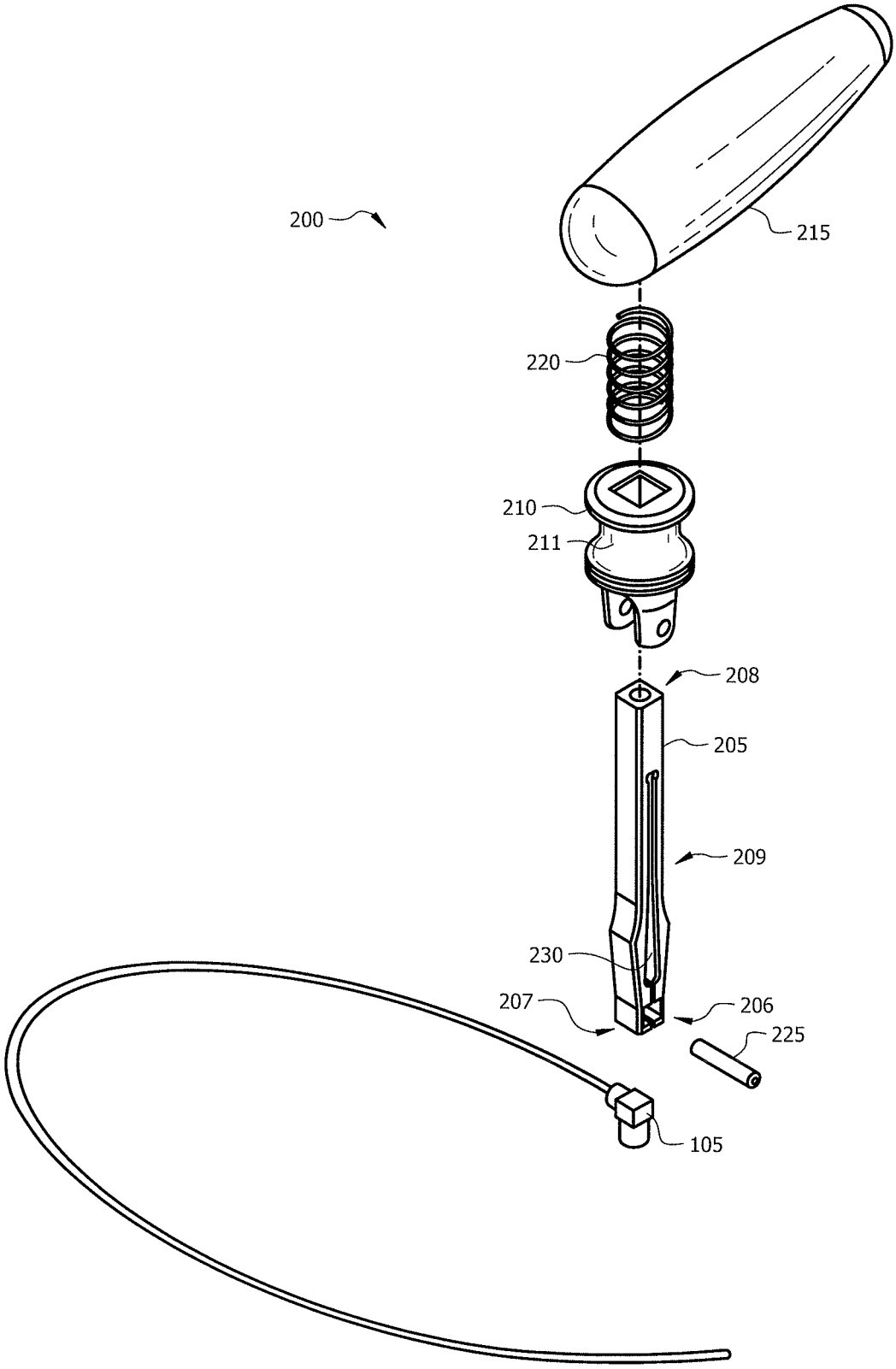
FIG. 2A is an exploded view of an example insertion tool for right-angled RF connectors, according to certain embodiments.
Figure 2B:
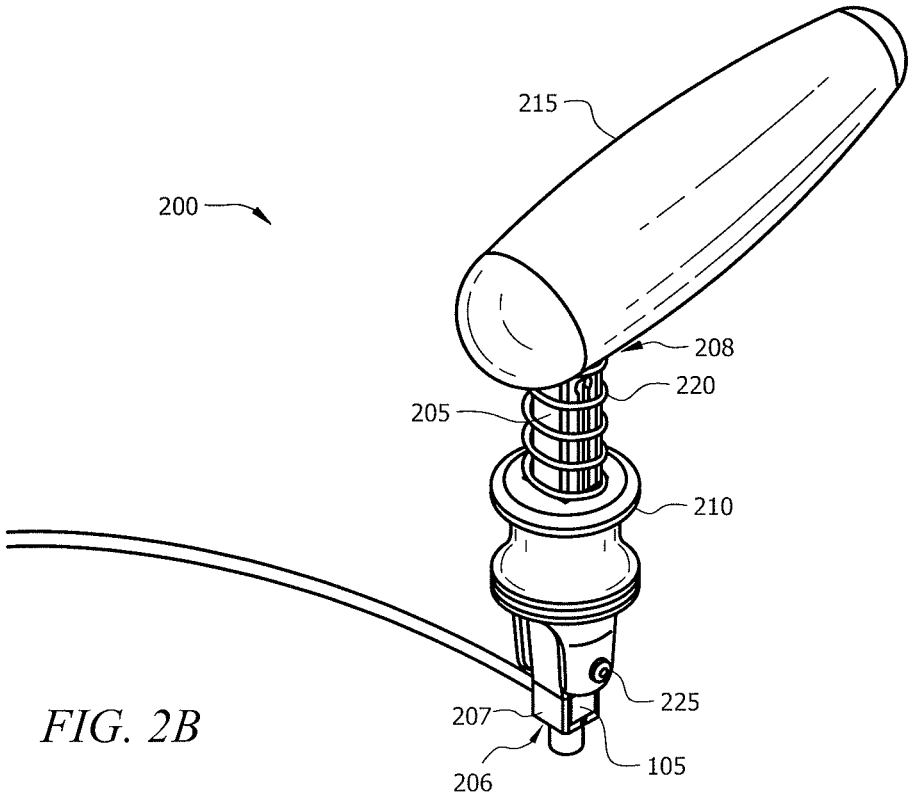
FIG. 2B is a perspective view of the example insertion tool for right-angled RF connectors in FIG. 2A, according to certain embodiments.
Figure 2C:
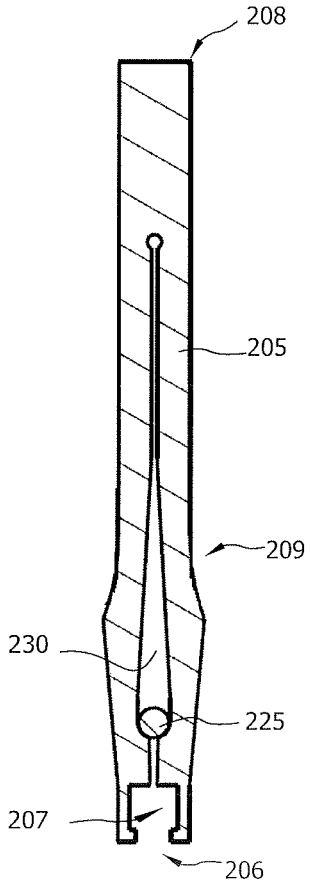
FIG. 2C is a cross-section view of an example shaft of the example insertion tool in FIGS. 2A and 2B, according to certain embodiments.
Figure 3A:
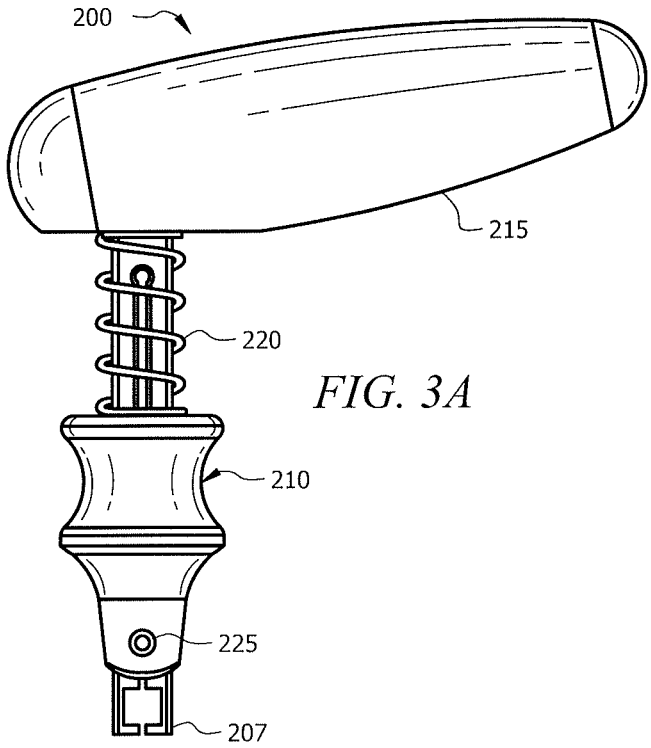
FIG. 3A is a side view of an example insertion tool in a first mode of operation, according to certain embodiments.
Figure 3B:
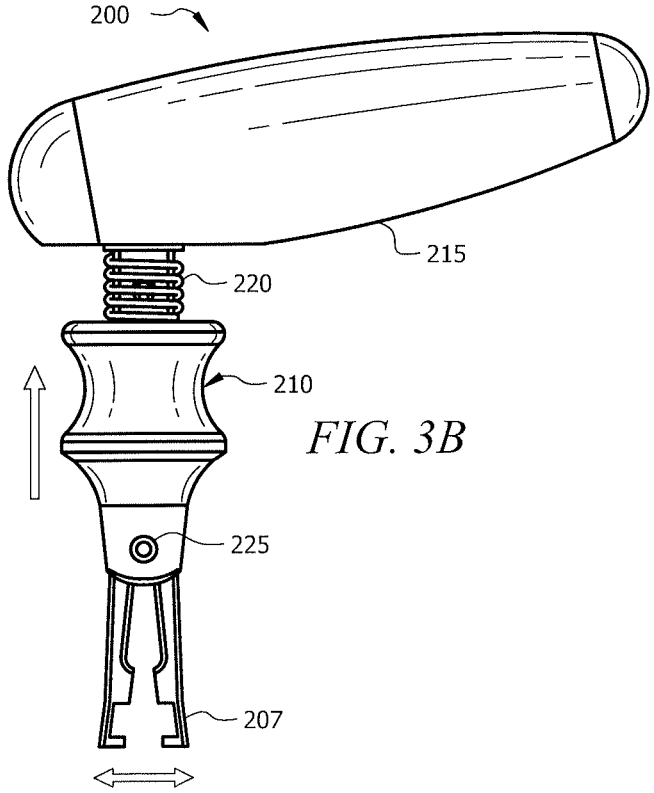
FIG. 3B is a side view of an example insertion tool in a second mode of operation, according to certain embodiments.
Figure 4:
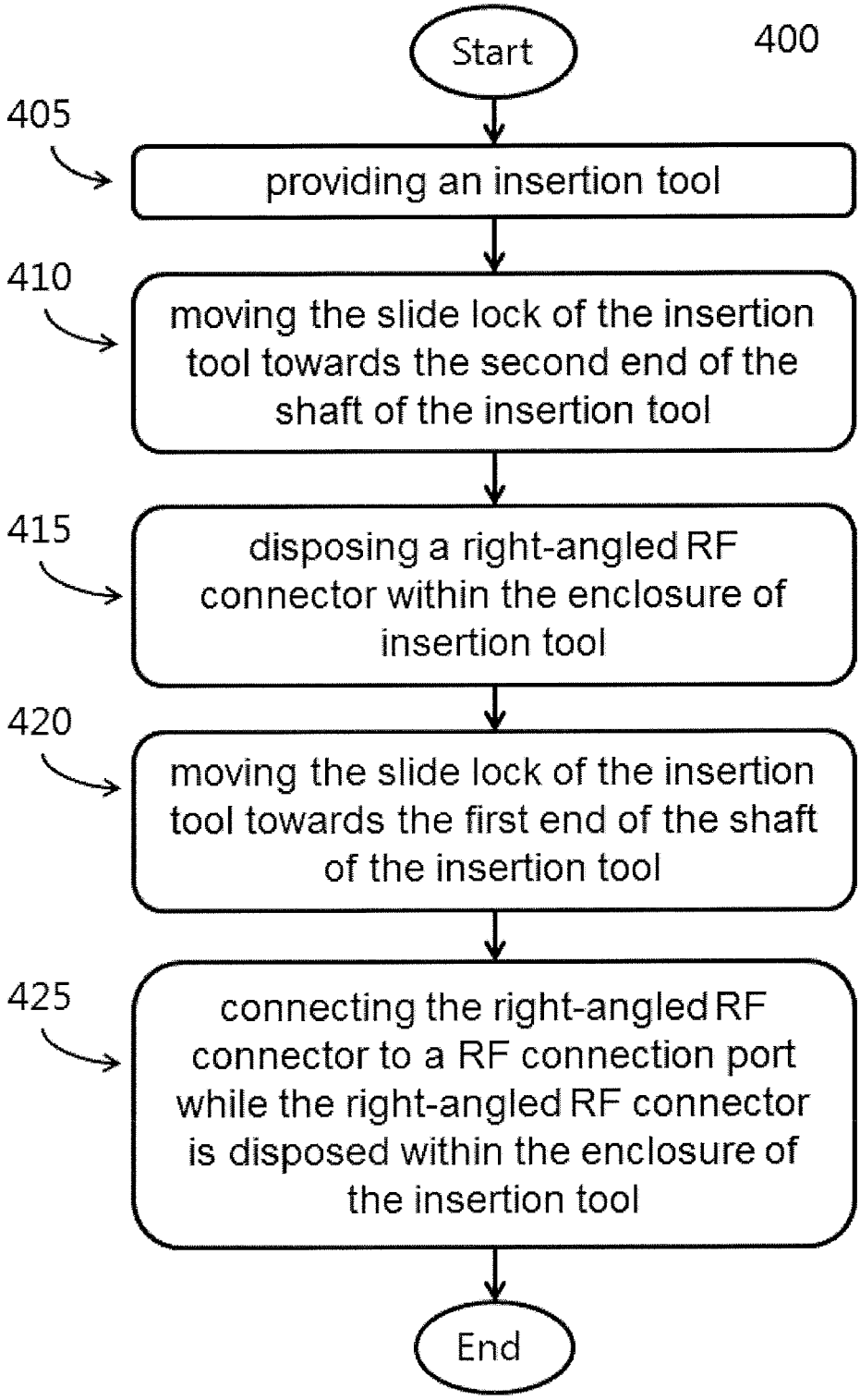
FIG. 4 is a flow chart diagram illustrating an example method of inserting a right-angled RF connector into a RF connection port using the example insertion tool in FIGS. 2A and 2B, according to certain embodiments.

Additional details are discussed in FIGS. 1 through 4. FIG. 1 illustrates an example system with a RF connection port and a right-angled RF connector. FIGS. 2A-2C illustrate an example insertion tool for right-angled RF connectors. FIGS. 3A and 3B illustrate the example insertion tool in a first and second mode of operation, respectively. FIG. 4 is a flow chart diagram illustrating an example method of inserting a right-angled RF connector into a RF connection port using the example insertion tool.

FIG. 1 illustrates an example system 100 with a RF connection port 115 and a right-angled RF connector 105, according to certain embodiments. System 100 may include a right-angled connector 105 coupled to a RF communications link 110, and RF connection port 115. RF communications link 110 may be any wire, link, or electrical cable configured to carry an RF signal. For example, RF communications link 110 may include coaxial cable or triaxial cable.

RF communications link 110 may be coupled to right-angled connector 105 on at least one end of RF communications link 110. Right-angled connector 105 provides a connecting portion to be inserted within a receiver, such as RF connection port 115. The connecting portion may be at a right angle (i.e., at 90 degrees) to the RF communications link 110. Right-angle connector 105 may have advantages over straight connectors by reducing the necessary overhead to provide the connection for RF communications link 110 and orient RF communications link 110 in a 90 degree angle relative to RF communications port 115 without bending RF communications link 110.

In certain embodiments, right-angled connector 105 is a sub-miniature push-on ("SMP") connector, which may also be referred to as a Gilbert push-on ("GPO") connector. SMP or GPO connectors may be adapted for particular applications, including being sized based on a particular application. SMP or GPO connectors have the advantage of being smaller, requiring less room to connect RF communications link 110, but also have disadvantages. More specifically, SMP connectors, due to their small size, may be easily damaged during installation. As shown in the example illustrated in FIG. 1, right-angled connector 105 may be extremely small compared to an installer's hand, e.g., hand 120. Although not drawn necessarily to scale, the small size of right-angled connector 105 compared to the fingers of hand 120 may result in a less accurate installation, potentially causing damage to right-angled connector 105. For example, angular misalignment between right-angled connector 105 and RF communications port 115 may damage one or more of right-angled connector 105 and RF communications port 115. During installation, angular misalignment may occur due to the small size of the SMP connector or tension in RF communications link 110. The small size of the SMP connector provides less area on which to grab and hold the connector, which may cause slips or improper orientation when inserting a portion of the connector into the receiving port.

In certain embodiments, right-angled RF connector 105 may include a insertion portion 106 and a body portion 107. For example, insertion portion 106 may be configured to be inserted within RF communications port 115 and body portion 107 may be configured to remain external to RF communications port 115 when installed. Body portion 107 may include a housing having a generally rectangular or square shape, as shown in the illustrated example in FIG. 1. In conventional methods of insertion, body portion 107 is grasped and used to maneuver inserted portion 106 into RF communications port 115. As described above, this maneuvering is often difficult, as right-angled RF connector 105 may be relatively small and the necessary force to insert insertion portion 106 is at a 90 degree angle to the rest of right-angled RF connector 105.

In certain embodiments, RF communications port 115 may be any suitable receiving port for a RF connector, such as right-angled RF connector 105. RF communications port 115 may be disposed within a device or component configured to receive an RF signal. For example, the device or component may include other components in addition to RF communications port 115. As illustrated, the other components may limit the maneuverability of right-angled connector 105 and RF communications link 110 near RF communications port 115. This may be caused by design constraints and other considerations. Accordingly, the installation of right-angled RF connector 105 may be hindered by surrounding components in addition to the alignment issues discussed above.

FIG. 2A is an exploded view of an example insertion tool 200 for right-angled RF connectors. Insertion tool 200 may include a shaft 205, a slide lock 210, and a pin 225. In certain embodiments, shaft 205 includes a first end 206 and a second end 208 opposite first end 206.

In certain embodiments, shaft 205 may include a middle portion 209 between first end 206 and second end 208. Proximate middle portion 209, shaft 205 may define a tapered hole 230. For example, shaft 205 may define tapered hole 230 having an opening that has a cross-section that tapers to have a smaller cross-section from first end 206 to second end 208, such as the example illustrated in FIG. 2C. Tapered hole 230 may be configured to receive pin 225, wherein pin 225 may be disposed through tapered hole 230 of shaft 205.

Slide lock 210 may be disposed over shaft 205. For example, slide lock 210 may define a hole through which shaft 205 may be inserted. In certain embodiments, slide lock 210 may include a coupling mechanism to couple slide lock 210 to shaft 205. In some embodiments, the coupling mechanism are holes defined on either side of a portion of slide lock 210, which are configured to receive the ends of pin 225, or portions thereof. For example, slide lock 210 may be coupled to shaft 205 by inserting pin 225 through a portion of slide lock 210 and through tapered hole 230 of shaft 205. In this manner, slide lock 210 may be coupled to shaft 205 and may also be coupled to pin 225.

In certain embodiments, first end 206 may include an enclosure 207. Enclosure 207 may be configured to open and close based on the positioning of pin 225 within tapered hole 230 of shaft 205. For example, enclosure 207 may be split into two separated parts that open in a jaw-like fashion when pin 225 moves in a direction from first end 206 to second end 207. The parts of enclosure 207 may similarly close when pin 225 moves in the opposite direction. Further details regarding the modes of operation of insertion tool 200 may be found in reference to FIGS. 3A and 3B below.

In certain embodiments, enclosure 207 is configured to hold a right-angled RF connector, such as right-angled RF connector 205. For example, a recess defined by enclosure 207 may substantially match the size and shape of body portion 107 of right-angled RF connector 205. As a specific example, enclosure 207 may include two matching enclosure parts that when positioned adjacently, form a rectangular or square recess the same size and shape as right-angled RF connector 205 or having a slightly larger size and shape as right-angled RF connector 205. In some embodiments, one or more of an interior width, interior length, and interior height of the recess defined by enclosure 207 may match the respective width, length, and height of body portion 107 of right-angled RF connector 205. For example, enclosure 207 may be configured to be able to receive more than one particular size of right-angled RF connector 205. In some cases, right-angled RF connector 205 may have varying lengths, but have the same height and width. In this manner, insertion tool 200 may be configured to accommodate various RF connectors by having enclosure 207 match one or more dimensions of the prospective RF connectors.

In certain embodiments, insertion tool 200 may handle right-angled RE connector 105 disposed within enclosure 207 and further, insert insertion portion 106 while body portion 107 remains within enclosure 207. For example, in certain embodiments, enclosure 207 surrounds right-angled RF connector 105 partially, leaving insertion portion 106 exposed at first end 206 of insertion tool 200. In some embodiments, enclosure 207 defines a hole through which insertion portion 106 extends while body portion 107 is surrounded by enclosure 207. In this manner, insertion tool 200 may maneuver right-angled RF connector 205 prior to and during insertion of insertion portion 106. Once inserted, insertion tool 200 may release right-angled RF connector 105 from enclosure 207 leaving right-angled RF connector 105 inserted within RF communications port 115.

In certain embodiments, slide lock 210 includes a circumferential groove 211. For example, slide lock 210 may include a groove that extends around the circumference of slide lock 210. Circumferential groove 211 may be shaped to fit a human finger or pair of fingers. For example, circumferential groove 211 may be configured to receive a pointer finger and a middle finger of an operator, wherein the operator is able to grasp slide lock 210 with those two fingers and move slide lock 210. This ergonomic feature may enhance the usability of insertion tool 200 by enabling the operator to use insertion tool 200 with one hand, by only requiring one or two fingers to move slide lock 210.

Other optional features may be present in certain embodiments. For example, in certain embodiments, insertion tool 200 may further include a handle 215 coupled to shaft 205. For example, handle 215 may be affixed to shaft 205 at second end 208 of shaft 205. Handle 215 may be any suitable size or shape for grasping. For example, handle 215 may be sized and shaped to be grasped by a human hand of an operator. As shown in the illustrated example in FIG. 2A, handle 215 may be generally cylindrical in shape, having one end configured to be coupled to shaft 205. In this manner, insertion tool 200 may be more securely held by an operator.

Certain optional features may be combined, according to certain embodiments. For example, insertion tool 200 may include both handle 215 and circumferential groove 211 on slide lock 210. In combination, insertion tool 200 may be operated single-handedly. For example, an operator may grasp insertion tool using the palm of the operator's hand on handle 215 and one or more fingers in circumferential groove 211 of slide lock 210. In this manner, an operator may use a single hand to grasp and move insertion tool 200 while also being able to move slide lock 210. This may free the operator's other hand for other tasks, such as moving other components out of the path of RF communications link 110, right-angled connector 105, and/or RF communications port 115 when insertion tool 200 is in use.

Insertion tool 200 may include other optional features, according to certain embodiments. For example, in certain embodiments, insertion tool 200 may include a spring 220. Spring 220 may be coupled to slide lock 210 such as to provide an opposing force to movement of slide lock 210 that causes extension or compression of spring 220. For example, spring 220 may be disposed over shaft 205 between a top of slide lock 210 and handle 215. As slide lock 210 moves up, spring 220 may be compressed between slide lock 210 and handle 215, thereby creating a force against slide lock 210 in the opposite direction towards first end 206. By providing the opposing force, spring 220 may provide an automatic restoring force to move slide lock 210 and close enclosure 207 around right-angled RF connector 205. In another manner, spring 220 may also ensure that enclosure 207 is not opened inadvertently by maintaining slide lock 210 in a lower position, thereby keeping pin 225 within a lower, or wider, position within tapered hole 230. In other embodiments, another restorative force mechanism may be used.

FIG. 2B is a perspective view of example insertion tool 200 assembled. As described above, slide lock 210 may be disposed over shaft 205 and may be coupled to shaft 205 via pin 225 disposed through a portion of slide lock 210 and tapered hole 230 of shaft 205. In this manner, the movement of slide lock 210 is coupled to movement of pin 225 within tapered hole 230 defined by shaft 205. For example, as slide lock 210 moves towards second end 208, pin 225 may also move towards second end 208. As it does so, pin 225 moves within tapered hole 230 towards a portion of tapered hole 230 with a smaller cross section. Pin 225 may contact a portion of the wall defined by tapered hole 230 while moving towards second end 208. This contact may translate the upwards force towards second end 208 on pin 225 from slide lock 210 into forces horizontal against the walls defined by tapered hole 230. Because tapered hole 230 decreases in cross section in the direction towards second end 208, pin 225 may cause portions of shaft 205 proximate first end 206 to separate. In opposite fashion, as slide lock 210 moves towards first end 206, pin 225 moves into a section of tapered hole 230 having a larger cross-section. As a result, the separated portions of shaft 205 may move towards one another.

FIG. 2C is a cross-section view of shaft 205 of insertion tool 200, according to certain embodiments. As described above, shaft 205 may include a middle portion 209 between first end 206 and second end 208. Proximate middle portion 209, shaft 205 may define a tapered hole 230. As shown in the illustration in FIG. 2C, shaft 205 may define tapered hole 230 having an opening that has a cross-section that tapers to have a smaller cross-section from first end 206 to second end 208. Tapered hole 230 may be tapered in any suitable manner, e.g., a linear taper, a non-linear taper, a partial taper such that the taper only occurs on a portion of tapered hole 230, etc. The example in FIG. 2C shows a relatively linear taper, but any other suitable taper may be used to allow the opening of enclosure 207 by moving pin 225 within tapered hole 230. The illustrated example in FIG. 2C shows tapered hole 230 having received pin 225 disposed through tapered hole 230 of shaft 205.

FIGS. 3A and 3B illustrate side views of example insertion tool 200 according to two modes of operation, according to certain embodiments. FIG. 3A illustrates insertion tool 200 in a "closed" mode, where slide lock 210 and pin 225 are proximate to first end 206 near enclosure 207. This closed mode may be the default position of insertion tool 200. For example, spring 220 may provide sufficient force to maintain the closed mode absent any external forces, such as force from an operator. In the closed mode, pin 225 may be in a portion of tapered hole 230 having a cross-section equal or greater than the cross-section of pin 225. In this manner, pin 225 may not push against the walls of tapered hole 230 to separate portions of shaft 205.

FIG. 3B illustrates insertion tool 200 in a "open" mode, wherein portions of shaft 205 near first end 206 and enclosure 207 are separated. In an open mode, slide lock 210 and pin 225 may be positioned away from first end 206 and closer to second end 208. In some embodiments, this is achieved by moving slide lock 210 towards handle 215 and away from first end 206.

In certain embodiments, movement of pin 225 towards second end 208 corresponds to an increased amount of opening of enclosure 207. For example, as shown in FIG. 3B, the positing of pin 225 away from first end 206 causes portions of shaft 205 to separate, causing the increased opening of enclosure 207. As discussed above, this may be a result of the movement of pin 225 against the walls of tapered hole 230 defined in shaft 205. As a result of the taper, pin 225 may force portions of shaft 205 apart, thereby increasing the opening of enclosure 207.

Once in open mode, insertion tool 200 may be positioned adjacent to right-angled RF connector 105. For example, an operator may position insertion tool 200 above right-angled RF connector 105 when the opening of enclosure 207 is large enough to allow the entry of body portion 107 within enclosure 207. Body portion 107 of right-angled RF connector 105 may be disposed within enclosure 207.

In certain embodiments, insertion tool 200 may be returned to the closed mode in FIG. 3A by moving slide lock 210 towards first end 206, thereby causing the opening of enclosure 207 to reduce and grasp body portion 107 of right-angled connector 105. In some embodiments, this is caused automatically via a restorative force of spring 220 or any other restorative force mechanism of insertion tool 200. Once grasped within enclosure 207, right-angled RF connector 105 may be maneuvered by insertion tool 200 and inserted within RF communications port 115. Insertion tool 200 may be returned to the open mode in FIG. 3B to release right-angled RF connector 105 after installation.

FIG. 4 is a flow chart diagram illustrating an example method 400 of inserting right-angled RF connector into RF communications port 115. Method 400 may begin at step 405, where a right-angled RF connector insertion tool may be provided. For example, insertion tool 200 may be provided in step 405, as shown assembled in FIG. 2B.

At step 410, slide lock 210 of insertion tool 200 may be moved towards second end 208 of shaft 205. For example, an operator or other mechanism may grasp a portion of slide lock 210 and move slide lock 210 towards second end 208. As a result, pin 225 may be moved within tapered hole 230 within shaft 205. As detailed above, this may cause an opening of enclosure 207 to widen.

At step 415, a right-angled RF connector, such as right-angled RF connector 105, may be disposed within enclosure 207 of insertion tool 200. For example, enclosure 207 may be moved over right-angled RF connector 105 such that right-angled RF connector 105 is inserted into a recess formed by enclosure 207. Accordingly, enclosure 207 may surround a portion of right-angled RF connector. In some embodiments, enclosure 207 may surround a body portion 107 of right-angled RF connector 105, leaving insertion portion 106 exposed.

Once right-angled RF connector 105 is disposed within enclosure 207, method 400 may move to step 420. At step 420, slide lock 210 of insertion tool 200 may be moved towards the first end 206 of shaft 205. Moving slide lock 210 towards first end 206 may move pin 225 towards first end 206. This may reduce the opening of enclosure 207, causing enclosure 207 to secure right-angled RF connector 105 within the recess defined by enclosure 207. In this manner, right-angled RF connector 105 may be secured within insertion tool 200 for subsequent movement and installation. and Once secured within enclosure 207, at step 425, right RF connector 105 may be connected to a RF communications port, such as RF communications port 115. In certain embodiments, step 425 may be carried out while right-angled RF connector 105 is disposed within enclosure 107 of insertion tool 200. For example, insertion portion 106 of right-angled RF connector 105 may remain exposed while right-angled RF connector 105 is disposed within enclosure 207. In this manner, insertion tool 200 may maneuver insertion portion 107 proximate to RF communications port 115 and be used to transfer force between right-angled RF connector 105 and RF communications port 115 to insert insertion portion 106 within RF communications port 115 while still disposed within enclosure 207. In this manner, insertion tool 200 may provide an improved method for inserting right-angled RF connectors into corresponding RF ports.

In certain embodiments, one or more of steps 410, 420, and 425 may be carried out single-handedly. For example, an operator may carry out one or more of steps 410, 420, and 425 using a single hand. In particular, insertion tool 200 may be so configured to allow the movement of slide lock 210 via the same hand used to grasp and move insertion tool 200. As a result, method 400 may be carried out more efficiently and accurately.

In certain embodiments, method 400 may include additional steps. For example, in certain embodiments, method 400 further includes the step of moving, after connecting right-angled RF connector 105 to the RF communications port 115, slide lock 210 towards second end 208 of shaft 205. In this manner, the opening of enclosure 207 may be increased. In these embodiments, method 400 may further include the step of removing insertion tool 200 from right-angled RF connector 105. For example, once the opening of enclosure 207 is sufficiently large, insertion tool 200 may be moved away from the inserted right-angled RF connector 105. In this manner, right-angled RF connector may be inserted and insertion tool 200 removed without disturbing the installed connector.

Modifications, additions, or omissions may be made to method 400 depicted in FIG. 4. Method 400 may include more, fewer, or other steps. While various components of insertion tool 200 were discussed in relation to the steps in method 400, the steps of method 400 may be taken using any suitable component or combination of components of insertion tool 200.

The present disclosure may provide numerous advantages. For example, an insertion tool may include a spring that provides a resistive force against the slide lock. The resistive force may cause the slide lock to move towards the first end, thereby allowing the enclosure to close without providing manual force to maintain the slide lock position. As another example, certain embodiments allow the enclosure to securely hold a right-angled RF connector. In securely holding the right-angled RF connector, the right-angled RF connector may be maneuvered and connected with greater precision and ease. As yet another example, the insertion tool may include a circumferential grove and a handle with which the insertion tool may be handled. An operator may hold the insertion tool via the handle and operate the slide lock with one or more fingers of the same hand. In certain embodiments, the insertion tool may be configured to be used single-handedly.

Other technical advantages will be readily apparent to one skilled in the art from the following figures, descriptions, and claims. Moreover, while specific advantages have been enumerated above, various embodiments may include all, some, or none of the enumerated advantages.

The scope of this disclosure encompasses all changes, substitutions, variations, alterations, and modifications to the example embodiments described or illustrated herein that a person having ordinary skill in the art would comprehend. The scope of this disclosure is not limited to the example embodiments described or illustrated herein. Moreover, although this disclosure describes and illustrates respective embodiments herein as including particular components, elements, functions, operations, or steps, any of these embodiments may include any combination or permutation of any of the components, elements, functions, operations, or steps described or illustrated anywhere herein that a person having ordinary skill in the art would comprehend. Furthermore, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative.

Although the present disclosure has been described with several embodiments, a myriad of changes, variations, alterations, transformations, and modifications may be suggested to one skilled in the art, and it is intended that the present disclosure encompass such changes, variations, alterations, transformations, and modifications as fall within the scope of the appended claims.

What is claimed is:

1. An apparatus, comprising:

a shaft, comprising:

a first end comprising an enclosure, wherein the enclosure defines a rectangular recess and is configured to hold a right-angled radio frequency ("RF") connector;

a second end opposite the first end; and a middle portion between the first end and the second end, the middle portion comprising a tapered hole, the tapered hole tapered in a direction from the first end to the second end;

a handle coupled to the shaft, wherein the handle extends from the second end of the shaft in a direction different than the direction from the first end to the second end of the shaft;

a slide lock disposed over the shaft, wherein the slide lock surrounds a length of the shaft and comprises a first connection portion and a second connection portion, the second connection portion disposed opposite of the tapered hole of the middle portion from the first connection portion; and a pin coupled to the slide lock at the first connection portion and the second connection portion, the pin disposed from the first connection portion through the tapered hole to the second connection portion, wherein movement of the slide lock is coupled to movement of the pin within the tapered hole of the shaft;

wherein the position of the pin within the tapered hole corresponds to an amount of opening of the enclosure; and wherein a connection portion of the right-angled RF connector remains exposed when held by the enclosure such that the right-angled RF connector is configured to be connected to a RF communications port without the enclosure being opened.

2. The apparatus of claim 1, further comprising a spring coupled to the slide lock, the spring configured to provide a resistive force against the slide lock.

3. The apparatus of claim 2, wherein the resistive force is configured to move the slide lock towards the first end.

4. The apparatus of claim 1, wherein the enclosure is configured to release the right-angled RF connector connected to a RF connector port by moving the slide lock towards the second end.

5. The apparatus of claim 1, wherein movement of the pin towards the second end corresponds to an increased amount of opening of the enclosure.

6. The apparatus of claim 1, wherein the slide lock comprises a circumferential grove.

7. The apparatus of claim 1, wherein the apparatus is configured to be operated single-handedly.

8. The apparatus of claim 1, wherein the enclosure further defines a circular hole oriented opposite the second end of the shaft, wherein an inserted portion of the right-angled RF connector is disposed through the circular hole when a body portion of the right-angled RF connector is held within the rectangular recess of the enclosure.

9. The apparatus of claim 1, wherein the right-angled RF connector is a right-angled sub-miniature push-on connector.

10. A method, comprising:

providing a right-angled RF connector insertion tool comprising:

a shaft comprising:

a first end comprising an enclosure, wherein the enclosure defines a rectangular recess and is configured to hold a right-angled radio frequency ("RF") connector;

a second end opposite the first end; and middle portion between the first end and second end, the middle portion comprising a tapered hole, the tapered hole tapered in a direction from the first end to the second end;

a handle coupled to the shaft, wherein the handle extends from the second end of the shaft in a direction different than the direction from the first end to the second end of the shaft;

a slide lock disposed over the shaft, wherein the slide lock surrounds a length of the shaft and comprises a first connection portion and a second connection portion, the second connection portion disposed opposite of the tapered hole of the middle portion from the first connection portion; and a pin coupled to the slide lock at the first connection portion and the second connection portion, the pin disposed from the first connection portion through the tapered hole to the second connection portion, wherein movement of the slide lock is coupled to movement of the pin within the tapered hole of the shaft;

moving the slide lock of the right-angled RF connector insertion tool towards the second end of the shaft;

disposing a right-angled RF connector within the enclosure of the right-angled RF connector insertion tool;

moving the slide lock of the right-angled RF connector insertion tool towards the first end of the shaft; and connecting the right-angled RF connector to a RF communications port while the right-angled RF connector is disposed within the enclosure of the right-angled RF connector insertion tool;

wherein a connection portion of the right-angled RF connector remains exposed when held by the enclosure such that the right-angled RF connector is connected to the RF communications port without the enclosure being opened.

11. The method of claim 10, wherein the steps of moving the slide lock, disposing the right-angled RF connector, and connecting the right-angled RF connector are carried out by the RF connector insertion tool single handedly.

12. The method of claim 10, further comprising:

moving, after connecting the right-angled RF connector to the RF communications port, the slide lock towards the second end of the shaft; and removing the RF connector insertion tool from the right-angled RF connector.

13. The method of claim 10, wherein the RF connector insertion tool further comprises a spring coupled to the slide lock, the spring configured to provide a resistive force against the slide lock.

14. The method of claim 10, wherein the slide lock comprises a circumferential grove.

15. The method of claim 10, wherein the enclosure further defines a circular hole oriented opposite the second end of the shaft, wherein an inserted portion of the right-angled RF connector is disposed through the circular hole when a body portion of the right-angled RF connector is held within the rectangular recess of the enclosure.

16. The method of claim 10, wherein the right-angled RF connector is a right-angled sub-miniature push-on connector.

17. A system comprising:

a right-angled RF connector;

a RF connection port configured to receive a portion of the right-angled RF connector;

a RF connector insertion tool comprising:

a shaft, the shaft comprising:

a first end comprising an enclosure, wherein the enclosure defines a rectangular recess and is configured to hold a right-angled radio frequency ("RF") connector;

a second end opposite the first end; and a middle portion between the first end and second end, the middle portion comprising a tapered hole, the tapered hole tapered in a direction from the first end to the second end;

a handle coupled to the shaft, wherein the handle extends from the second end of the shaft in a direction different than the direction from the first end to the second end of the shaft;

a slide lock disposed over the shaft, wherein the slide lock surrounds a length of the shaft and comprises a first connection portion and a second connection portion, the second connection portion disposed opposite of the tapered hole of the middle portion from the first connection portion; and a pin coupled to the slide lock at the first connection portion and the second connection portion, the pin disposed from the first connection portion through the tapered hole to the second connection portion, wherein movement of the slide lock is coupled to movement of the pin within the tapered hole of the shaft;

wherein the RF connector insertion tool is configured to hold the right-angled RF connector within the enclosure with a connection portion of the right-angled RF connector exposed and connect the right-angled RF connector into the RF connection port while the right-angled RF connector is held within the enclosure without the enclosure being opened.

18. The system of claim 17, wherein the RF connector insertion tool further comprises a spring coupled to the slide lock, the spring configured to provide a resistive force against the slide lock.

19. The system of claim 17, wherein the enclosure further defines a circular hole oriented opposite the second end of the shaft, wherein an inserted portion of the right-angled RF connector is disposed through the circular hole when a body portion of the right-angled RF connector is held within the rectangular recess of the enclosure.

20. The system of claim 17, wherein the right-angled RF connector is a right-angled sub-miniature push-on connector.

* * * * *